US006412710B1

(12) United States Patent
Lin et al.

(10) Patent No.: US 6,412,710 B1
(45) Date of Patent: Jul. 2, 2002

(54) SPRAYER DEVICE HAVING VARIOUS KINDS OF OUTWARD FLOWS

(75) Inventors: Yen Tang Lin, No. 14, Lane 69, Sec. 4, Tien Gin Road, Taichung 406 (TW); Bi Guang Tsai, Taichung (TW)

(73) Assignee: Yen Tang Lin, Taichung (TW)

( * ) Notice: Subject to any disclaimer, the term of this patent is extended or adjusted under 35 U.S.C. 154(b) by 0 days.

(21) Appl. No.: 09/861,453

(22) Filed: May 17, 2001

(51) Int. Cl.[7] ..... B05B 3/04

(52) U.S. Cl. ..... 239/436; 239/447; 239/461; 239/548; 239/553; 239/569; 239/381; 239/382

(58) Field of Search ..... 239/436, 440, 239/441, 443, 447, 448, 449, 461, 505, 533.1, 548, 553, 569, 570, 380, 381, 382

(56) References Cited

U.S. PATENT DOCUMENTS 4,190,207 A * 2/1980 Fienhold et al. ..... 239/447
4,903,897 A * 2/1990 Hayes ..... 239/443
5,215,258 A * 6/1993 Jursich ..... 239/394
5,397,064 A * 3/1995 Heitzman ..... 239/381
5,518,181 A * 5/1996 Shames et al. ..... 239/381
5,862,985 A * 1/1999 Neibrook et al. ..... 239/449
6,076,743 A * 6/2000 Fan ..... 239/449

* cited by examiner

*Primary Examiner*—Robin O. Evans

(57) ABSTRACT

A sprayer device includes a housing coupled to a water reservoir, a block having a passageway and a number of outlets. A locking member is slidably received in the passageway of the block to block some of the outlets of the block alternatively when the blocking member is slided along the passageway of the block. A number of paddle wheels are rotatably received in the block for controlling the outward flowing water. A shaft is received in the block, and a cap is threaded to the block and has a valve seat for engaging with the shaft to control the outward flowing water.

17 Claims, 6 Drawing Sheets

SPRAYER DEVICE HAVING VARIOUS KINDS OF OUTWARD FLOWS

BACKGROUND OF THE INVENTION

1. Field of the Invention

The present invention relates to a sprayer device, and more particularly to a sprayer device having various kinds of outward water flows.

2. Description of the Prior Art

Typical sprayer devices comprise a control ferrule rotatably attached to the front portion of the sprayer device, such as the sprayer guns or the sprayer nozzles, and including three or more openings or orifices formed or provided in the peripheral portion thereof for selectively or alternatively aligning with a water passage that is provided in the sprayer device when the control ferrule is rotated relative to the sprayer device. Normally, only one type of the water flows may flow out of the sprayer device each time. In addition, only few types of the outward water flows may be selected by the users. U.S. Pat. No. 4,903,897 to Hayes discloses one of the typical sprayer devices including five types of outward water flows that may be selected by the users, and including only one of the outward water flows may be selected by the users each time.

The present invention has arisen to mitigate and/or obviate the afore-described disadvantages of the conventional sprayer devices.

SUMMARY OF THE INVENTION

The primary objective of the present invention is to provide a sprayer device including various kinds of outward water flows.

In accordance with one aspect of the invention, there is provided a sprayer device comprising a housing including an inlet for coupling to a water reservoir and for receiving water from the water reservoir, a block including a passageway formed therein and including a plurality of outlets formed therein and communicating with the passageway of the block, a blocking member slidably received in the passageway of the block to block some of the outlets of the block alternatively when the blocking member is slided and moved along the passageway of the block, and means for guiding the water to flow into the passageway of the block and to move the blocking member along the passageway of the block and to block the outlets of the block alternatively.

The guiding means includes a casing having a peripheral fence extended therein for forming a chamber within the peripheral fence, the chamber of the peripheral fence is communicating with the passageway of the block for allowing the water to flow into the passageway of the block.

The guiding means includes a cover secured onto the fence and having at least one passage formed therein and communicating with the channel of the block.

The guiding means includes a port formed in the casing and communicating with the chamber of the peripheral fence, and a seat secured to the housing and having at least one opening formed therein and communicating with the inlet of the housing and selectively communicating with the port of the casing when the casing is rotated relative to the seat.

In accordance with another aspect of the invention, there is provided a sprayer device comprising a housing including an inlet for coupling to a water reservoir and for receiving water from the water reservoir, a block including a plurality of cavities formed therein and including a plurality of exits formed therein and communicating with the cavities of the block, a plurality of paddle wheels rotatably received in the cavities of the block respectively, and means for guiding the water to flow into the cavities of the block and to rotate the paddle wheels in order to change the water flowing out of the exits of the block.

The guiding means includes a casing having a hole formed therein and having a peripheral fence extended in the hole of the casing for forming a gap between the casing and the peripheral fence and for communicating with the cavities of the block and for allowing the water to flow into the cavities of the block.

The guiding means includes a port formed in the casing and communicating with the gap formed between the casing and the peripheral fence, and a seat secured to the housing and having at least one opening formed therein and communicating with the inlet of the housing and selectively communicating with the port of the casing when the casing is rotated relative to the seat.

In accordance with a further aspect of the invention, there is provided a sprayer device comprising a housing including an inlet for coupling to a water reservoir and for receiving water from the water reservoir, a block attached to the housing and including a hole formed therein and communicating with the inlet of the housing for receiving the water, a cap threaded to the hole of the block and including a bore formed therein and including a valve seat provided in the bore of the cap, a shaft secured to the block and slidably received in the cap for selectively engaging with the valve seat of the cap, and means for guiding the water to flow into the hole of the block. The valve seat of the cap is movable relative to the shaft to control an outward flowing water through the bore of the cap when cap is rotated relative to the block and the shaft.

The cap includes a front portion having an opening formed therein and communicating with the bore of the cap and having an inner diameter smaller than that of the bore of the cap, the shaft includes a head extended forward therefrom and slidably engaged in the opening of the cap.

The cap includes at least one ear extended forward therefrom for rotating the cap relative to the block. The shaft includes a longitudinal groove formed therein for communicating with the opening of the cap when the valve seat of the cap is disengaged from the shaft.

The guiding means includes a seat secured to the housing and having a bore formed therein, a casing rotatably secured to the housing and having a bore formed therein, and a pipe extended from the block and engaged through the bore of the casing and engaged with the bore of the seat.

A hood is further provided and rotatably received in the housing and includes a peripheral shoulder formed therein, the seat includes a peripheral flange extended therefrom for engaging with the peripheral shoulder of the hood and for rotatably securing the hood to the housing.

A control ferrule is further provided and rotatably engaged in the housing and engaged between the hood and the housing, and means for securing the hood to the control ferrule for allowing the hood to be rotated relative to the housing with the control ferrule.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
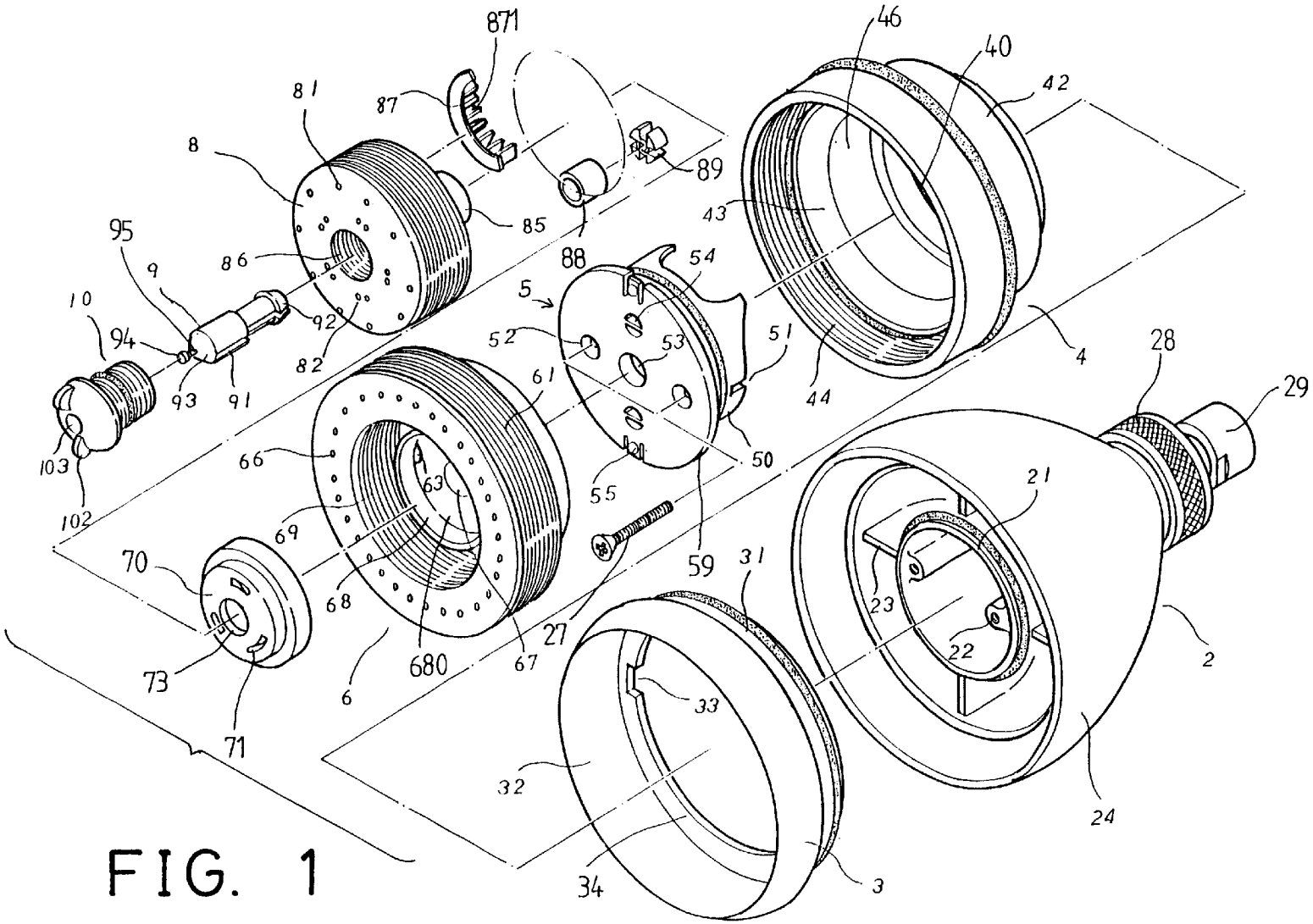
FIG. 1 is an exploded view of a sprayer device in accordance with the present invention.
Figure 2:
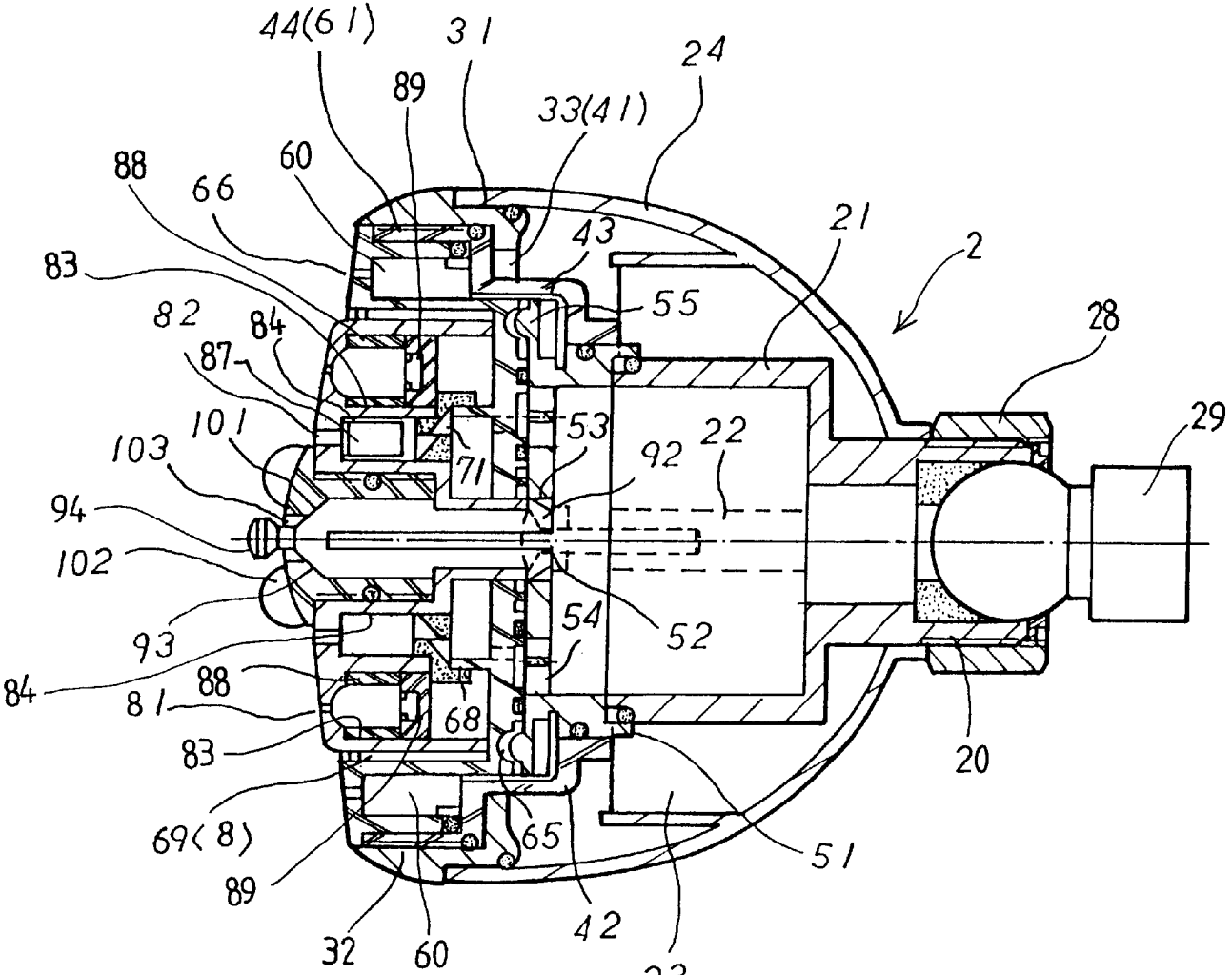
FIG. 2 is a cross sectional view of the sprayer device.
Figure 3:
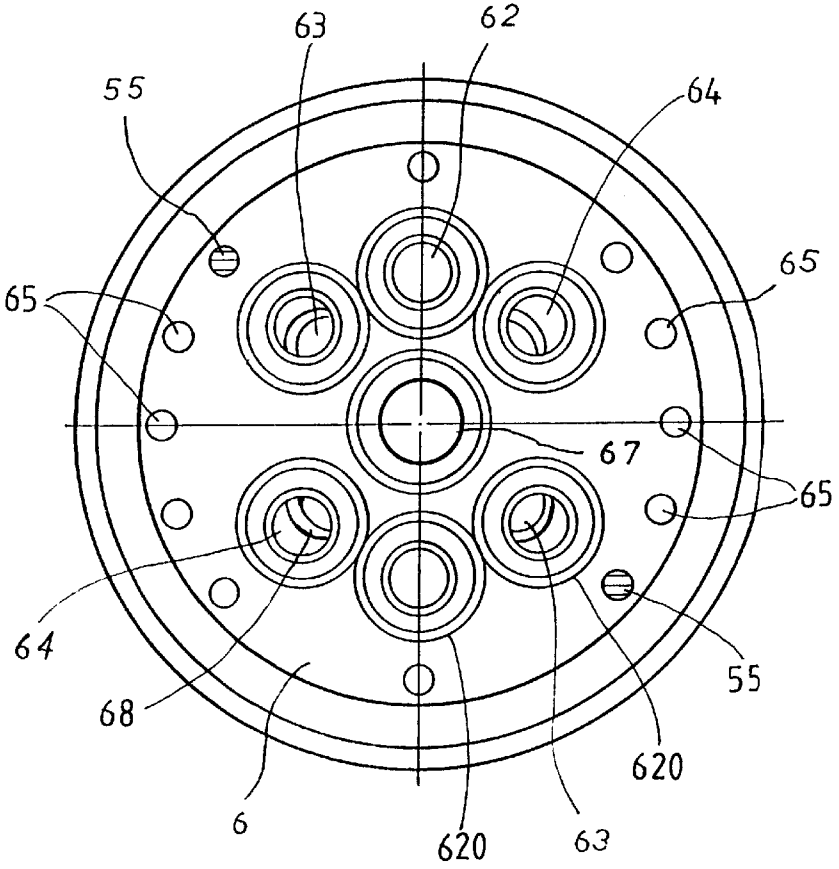
FIG. 3 is a partial rear plane schematic view showing the rear portion of the control plate.

Referring to the drawings, and initially to FIGS. 1–3, a sprayer device in accordance with the present invention comprises a sprayer body 2 including a peripheral wall 21 secured in a housing 24 with one or more ribs 23, and including one or more studs 22 provided in the peripheral wall 21, and including a rear inlet 20 directly coupled to a water reservoir with a lock device 28, or indirectly coupled to the water reservoir with a coupler 29 and the lock device 28, and for allowing the water from the water reservoir to flow into the peripheral wall 21 of the sprayer body 2.

A control ferrule 3 includes a reduced cylindrical member 31 or a cylindrical member 31 having a reduced diameter than that of the control ferrule 3 and rotatably engaged in the housing 24, and includes a space 32 formed therein, and includes one or more notches 33 formed in a peripheral partition 34 thereof. A hood 4 includes a reduced cylindrical member 42 or a cylindrical member 42 having a reduced diameter than that of the hood 4 and rotatably engaged in the space 32 of the control ferrule 3, and includes a chamber 43 formed therein, and includes a bore 40 formed in the rear portion thereof and communicating with the chamber 43 thereof and communicating with the inlet 20 of the sprayer body 2 for allowing the water to flow into the hood 4. The hood 4 includes an inner thread 44 formed in the front portion thereof, and includes a peripheral shoulder 46 formed in the middle portion thereof. The hood 4 includes one or more extensions 41 engaged into the notches 33 of the control ferrule 3 (FIGS. 2, 4–8), such that the hood 4 may be rotated relative to the housing 24 by the control ferrule 3.

A seat 5 includes a peripheral flap 50 extended rearward therefrom and engaged onto the peripheral wall 21 of the sprayer body 2, and includes one or more slots 51 formed in the peripheral flap 50 for receiving the ribs 23 of the sprayer body 2 and for preventing the seat 5 from rotating relative to the sprayer body 2. One or more fasteners 27 are engaged through the holes 52 of the seat 5 and threaded to the studs 22 of the sprayer body 2 for securing the seat 5 to the sprayer body 2. The seat 5 includes a peripheral flange 59 laterally or radially extended outward therefrom for engaging with the peripheral shoulder 46 of the hood 4 and for rotatably securing the hood 4 and the control ferrule 3 to the sprayer body 2. The seat S includes a bore 53 formed in the center portion thereof, and includes one or more openings 54 formed therein, and includes one or more spring-biased projection 55 provided thereon, such as provided in the outer peripheral portion thereof.

Figure 8:
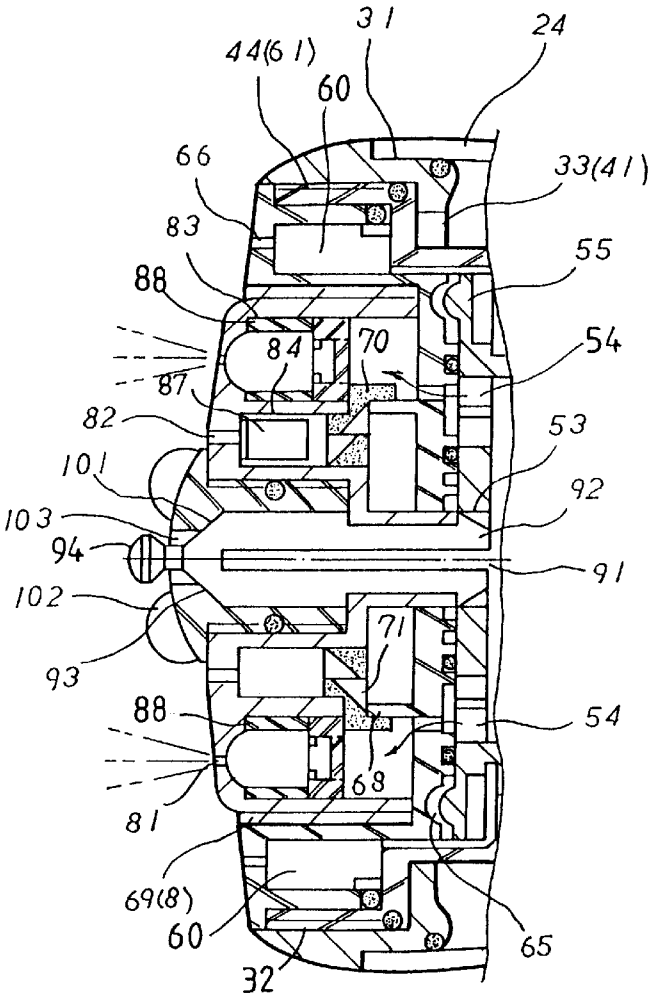
Figure 7:
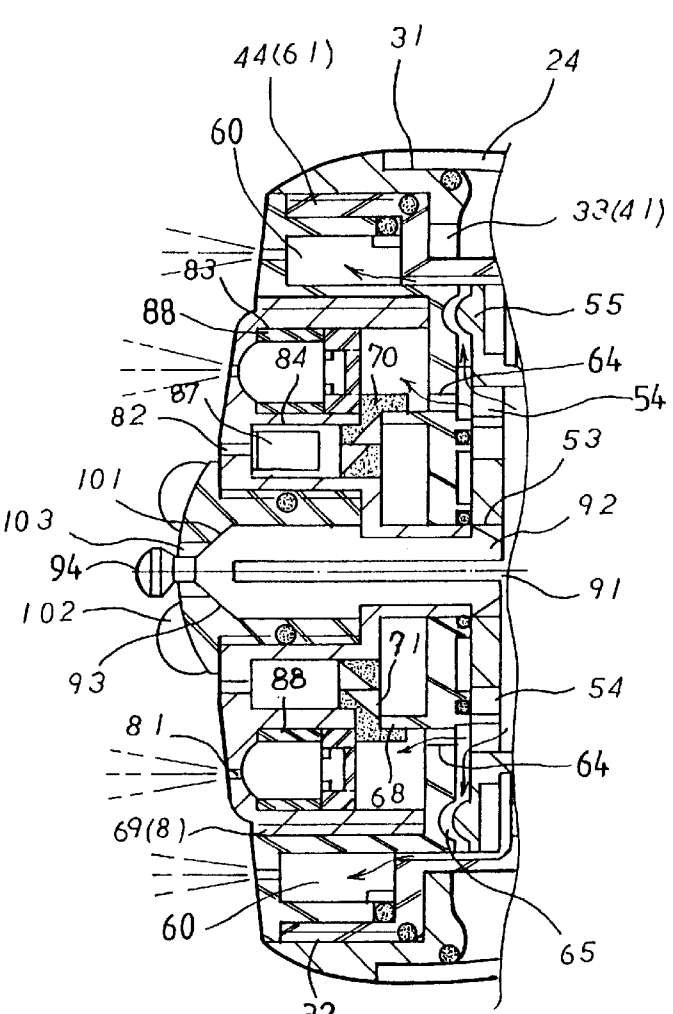

A casing 6 includes an outer thread 61 formed therein for threading with the inner thread 44 of the hood 4 and for securing to the hood 4, such that the casing 6 may also be rotated relative to the seat 5 and the sprayer body 2 with the hood 4 and the control ferrule 3. The casing 6 includes an inner threaded hole 69 formed therein, and includes a peripheral fence 68 extended into the threaded hole 69 thereof for forming a chamber 680 within the fence 68, and includes a bore 67 formed in the center portion thereof, and includes three or three pairs of ports 62, 63, 64 formed around the bore 67 of the casing 6 (FIG. 3) and formed or defined by cylindrical turrets 620, and includes a number of depressions 65 formed in the peripheral portion thereof for receiving the spring-biased projections 55 of the seat 5 and for adjustably securing the casing 6 to the seat 5 and thus to the sprayer body 2 at any selected angular position by the spring-biased projection 55. The ports 62 of the casing 6 are blind holes or are blocked. The peripheral fence 68 is engaged through the middle portion of the ports 63, 64. The ports 63 are communicated with the inner portion of the peripheral fence 68 (FIGS. 1, 3), and the other ports 64 are communicated with the outer portion of the peripheral fence 68 (FIGS. 3, 7, 8). The casing 6 includes a peripheral channel 60 formed therein, and includes a number of apertures 66 formed in the outer peripheral portion thereof and communicating with the peripheral channel 60 thereof.

A cover 70 is engaged onto the peripheral fence 68 of the casing 6 and includes one or more passages 71 and a center bore 73 formed therein for communicating with the bore 67 and the ports 62–64 of the casing 6. A block 8 is threaded in the threaded hole 69 of the casing 6, and includes a peripheral passageway 84 formed therein (FIGS. 2, 4–8), and includes a number of cavities 83 formed therein, such as formed around the peripheral passageway 84 of the block 8, and includes a number of outlets 81 formed therein and communicating with the cavities 83 thereof respectively, and includes a number of exits 82 formed therein and communicating with the peripheral passageway 84 thereof. A curved and slidable blocking member 87 is slidably received in the peripheral passageway 84 of the block 8 and includes one or more fins 871 extended therefrom. One or more ducts 88 and paddle wheels 89 are received in the cavities 83 of the block 8 respectively. The block 8 includes a pipe 85 extended rearward therefrom and engaged into the bore 73 of the cover 70 and the bore 67 of the casing 6 and communicating with the bore 53 of the seat 5. The block 8 includes a threaded hole 86 formed therein.

Figure 9:
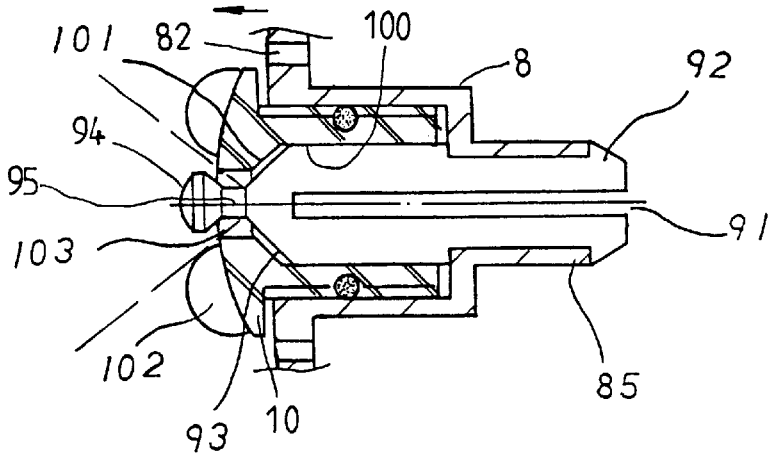
FIGS. 9, 10, 11 are enlarged partial cross sectional views illustrating the operation of the sprayer device.
Figure 10:
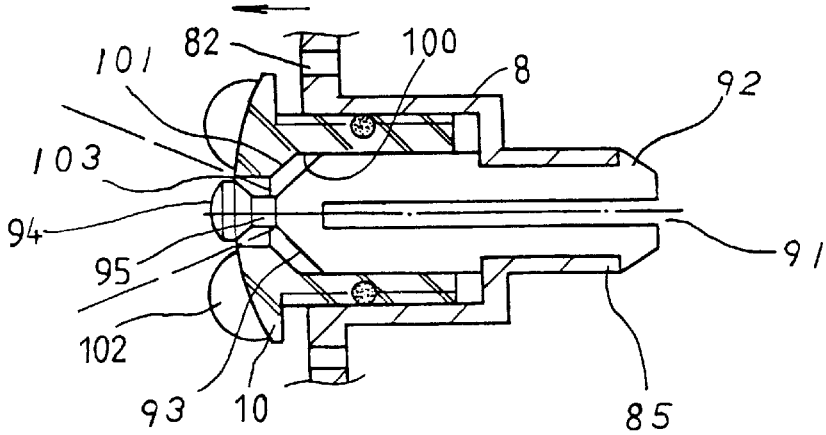
Figure 11:
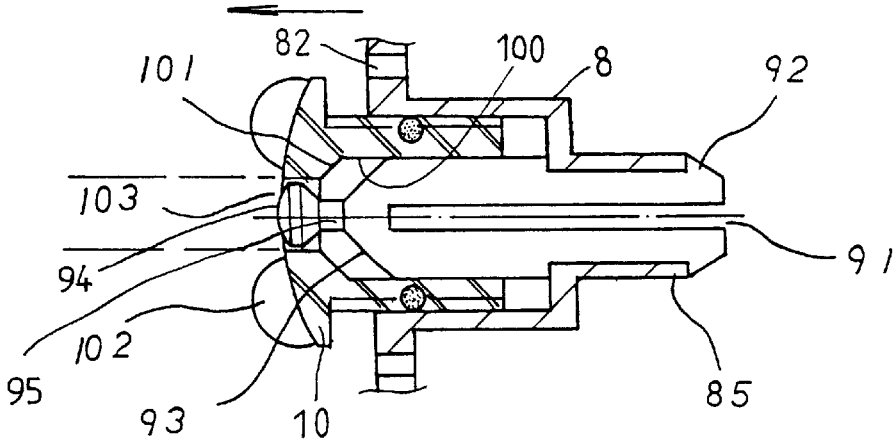

As best shown in FIGS. 9–11, a cap 10 is threaded to the threaded hole 86 of the block 8 and includes a bore 100 and an opening 103 formed therein, and includes a valve seat 101 formed therein, and includes one or more ears 102 extended outward therefrom, for allowing the cap 10 to be rotated relative to the block 8 and to be moved inward and outward of the threaded hole 86 of the block 8. A shaft 9 is received in the bore 100 of the cap 10 and includes a latch 92 provided in the rear end thereof for latching to the pipe 85 of the block 8 and thus for securing the shaft 9 within the threaded hole 86 of the block 8. The shaft 9 includes a tapered surface or a valve member 93 formed or provided in the front portion thereof for engaging with the valve seat 101 of the cap 10, and includes an extension 95 extended forward therefrom and a head 94 secured or provided on the free end of the extension 95. The head 94 has an outer diameter greater than that of the extension 95 and smaller than that of the shaft 9 for slidably engaged in the opening 103 of the cap 10. The shaft 9 includes a longitudinal groove 91 formed therein for allowing the water to flow out through the opening 103 of the cap 10 when the valve member 93 of the shaft 9 is disengaged from the valve seat 101 of the cap 10. The opening 103 of the cap 10 may be blocked when the valve member 93 of the shaft 9 is engaged with the valve seat 101 of the cap 10.

In operation, as shown in FIG. 2, when the casing 6 is rotated relative to the seat 5 to align the blocked ports 62 of the casing 6 with the openings 54 of the seat 5, and when the valve member 93 of the shaft 9 is engaged with the valve seat 101 of the cap 10, the water is blocked and may not flow out through the sprayer body 2.

Figure 4:
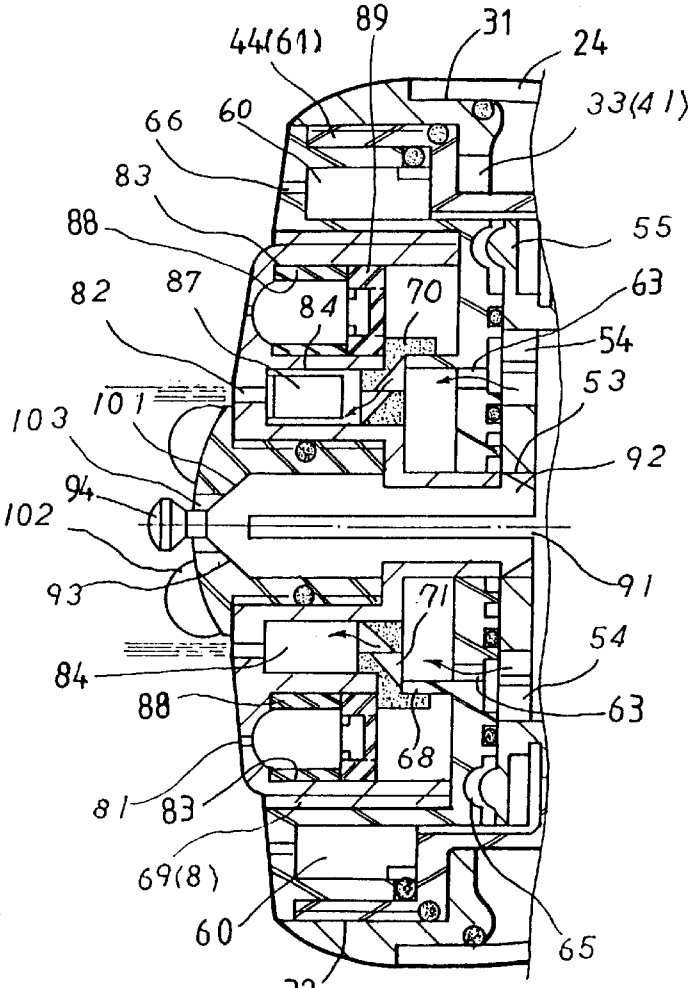
FIGS. 4, 5, 6, 7, 8 are partial cross sectional views similar to FIG. 2, illustrating the operation of the sprayer device.

As shown in FIG. 4, when the casing 6 is rotated relative to the seat 5 to align the ports 63 of the casing 6 with the openings 54 of the seat 5, the water from the openings 54 of the seat 5 may flow into the chamber 680 of the fence 68 and may flow through the passages 71 of the cover 70 and may flow into the peripheral passageway 84 of the block 8. The slidable blocking member 87 may thus be forced to slide along the peripheral passageway 84 of the block 8 by the water such that some of the exits 82 of the block 8 may be changeably or alternatively blocked by the blocking member 87, and such that the water may be caused to flow out through some of the exits 82 of the block 8 alternatively.

Figure 5:
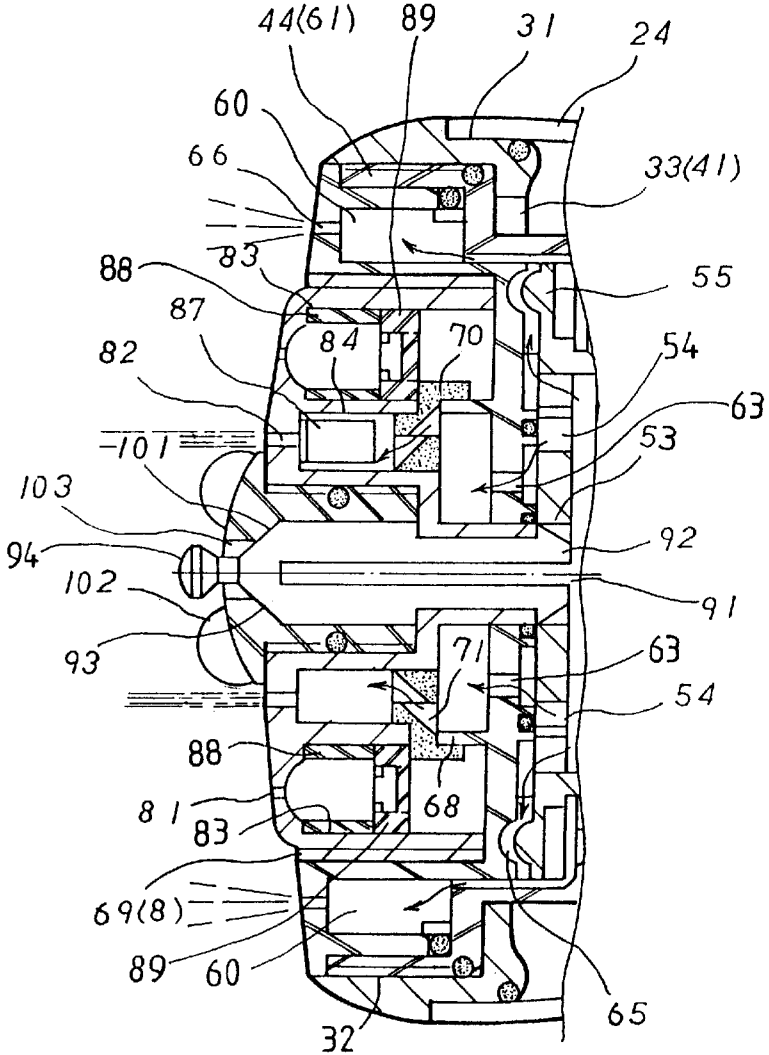

As shown in FIG. 5, when the ports 63 of the casing 6 are partially communicating with the openings 54 of the seat 5, i.e., the cylindrical turret 620 of the port 63 is engaged with the middle portion of the opening 54 of the seat 5, or the opening 54 of the seat 5 is not completely aligned within the turret 620 of the port 63, a portion of the water from the openings 54 of the seat 5 may also flow into the peripheral passageways 84 of the block 8 and may flow out through some of the exits 82 of the block 8 alternatively. The other portion of the water from the openings 54 of the seat 5 may flow into the peripheral channel 60 of the casing 6 and may thus flow out through the apertures 66 of the casing 6.

Figure 6:
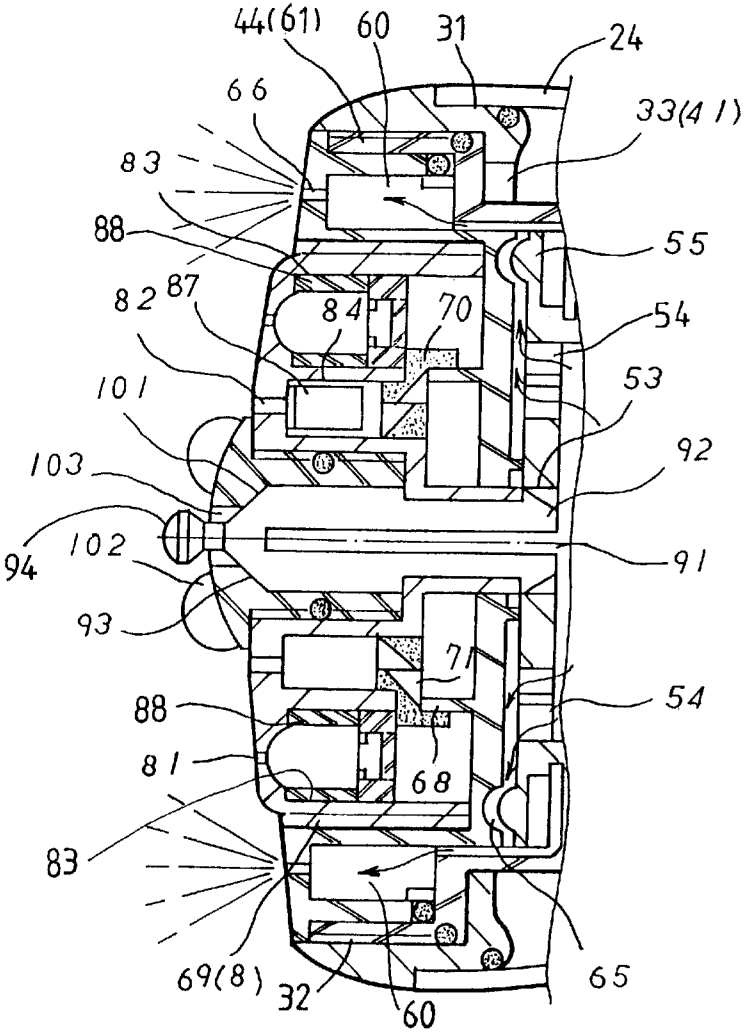

As shown in FIG. 6, when the ports 62, 63, 64 of the casing 6 are disengaged from the openings 54 of the seat 5, the water from the openings 54 of the seat 5 may only flow into the peripheral channel 60 of the casing 6 and may thus flow out through the apertures 66 of the casing 6.

As shown in FIG. 7, when the casing 6 is further rotated relative to the seat 5 to partially align the ports 64 of the casing 6 with the openings 54 of the seat 5, a portion of the water from the openings 54 of the seat 5 may also flow into the peripheral channel 60 of the casing 6 and may thus flow out through the apertures 66 of the casing 6. The other portion of the water may flow through the ports 64 of the casing 6 and may flow through the gap formed between the casing 6 and the peripheral fence 68 and may bypass the cover 70 and may flow into the cavities 83 of the block 8. The paddle wheels 89 may be rotated or propelled by the water flowing into the cavities 83 of the block 8 such that the water may intermittently flow out through the outlets 81 of the block 8.

As shown in FIG. 8, when the casing 6 is further rotated relative to the seat 5 to completely align the ports 64 of the casing 6 with the openings 54 of the seat 5, the water may only flow through the ports 64 of the casing 6 and may only intermittently flow out through the outlets 81 of the block 8 via the paddle wheels 89 that are rotatably received in the cavities 83 of the block 8.

As shown in FIG. 2, when the casing 6 is further rotated relative to the seat 5 to align the blocked ports 62 of the casing 6 with the openings 54 of the seat 5 again, the water is blocked and may not flow out through the sprayer body 2.

Referring next to FIGS. 9–11, when the cap 10 is rotated relative to the block 8, the valve member 93 of the shaft 9 may be gradually moved away from the valve seat 101 of the cap 10, in order to change the outward flow of the water through the opening 103 of the cap 10. The conventional sprayer devices have not rotatable or adjustable cap provided or threaded to the front portion of the sprayer device for adjusting the outward flow of the water.

Accordingly, the sprayer device in accordance with the present invention includes various kinds of outward water flows.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A sprayer device comprising:

a housing including an inlet for coupling to a water reservoir and for receiving water from the water reservoir, a block including a passageway formed therein and including a plurality of outlets formed therein and communicating with said passageway of said block, a blocking member slidably received in said passageway of said block to block some of said outlets of said block alternatively when said blocking member is slided and moved along said passageway of said block, and means for guiding the water to flow into said passageway of said block and to move said blocking member along said passageway of said block and to block said outlets of said block alternatively.

2. The sprayer device according to claim 1, wherein said guiding means includes a casing having a peripheral fence extended therein for forming a chamber within said peripheral fence, said chamber of said peripheral fence is communicating with said passageway of said block for allowing the water to flow into said passageway of said block.

3. The sprayer device according to claim 2, wherein said guiding means includes a cover secured onto said fence and having at least one passage formed therein and communicating with said channel of said block.

4. The sprayer device according to claim 2, wherein said guiding means includes a port formed in said casing and communicating with said chamber of said peripheral fence, and a seat secured to said housing and having at least one opening formed therein and communicating with said inlet of said housing and selectively communicating with said port of said casing when said casing is rotated relative to said seat.

5. The sprayer device according to claim 4 further comprising means for retaining said casing to said seat.

6. A sprayer device comprising:

a housing including an inlet for coupling to a water reservoir and for receiving water from the water reservoir, a block including a plurality of cavities formed therein and including a plurality of exits formed therein and communicating with said cavities of said block, a plurality of paddle wheels rotatably received in said cavities of said block respectively, and means for guiding the water to flow into said cavities of said block and to rotate said paddle wheels in order to change the water flowing out of said exits of said block.

7. The sprayer device according to claim 6, wherein said guiding means includes a casing having a hole formed therein and having a peripheral fence extended in said hole of said casing for forming a gap between said casing and said peripheral fence and for communicating with said cavities of said block and for allowing the water to flow into said cavities of said block.

8. The sprayer device according to claim 7, wherein said guiding means includes a port formed in said casing and communicating with said gap formed between said casing and said peripheral fence, and a seat secured to said housing and having at least one opening formed therein and communicating with said inlet of said housing and selectively communicating with said port of said casing when said casing is rotated relative to said seat.

9. The sprayer device according to claim 8 further comprising means for retaining said casing to said seat.

10. A sprayer device comprising:

a housing including an inlet for coupling to a water reservoir and for receiving water from the water reservoir, a block attached to said housing and including a hole formed therein and communicating with said inlet of said housing for receiving the water, a cap threaded to said hole of said block and including a bore formed therein and including a valve seat provided in said bore of said cap, a shaft secured to said block and slidably received in said cap for selectively engaging with said valve seat of said cap, and means for guiding the water to flow into said hole of said block, said valve seat of said cap being movable relative to said shaft to control an outward flowing water through said bore of said cap when cap is rotated relative to said block and said shaft.

11. The sprayer device according to claim 10, wherein said cap includes a front portion having an opening formed therein and communicating with said bore of said cap and having an inner diameter smaller than that of said bore of said cap, said shaft includes a head extended forward therefrom and slidably engaged in said opening of said cap.

12. The sprayer device according to claim 10, wherein said cap includes at least one ear extended forward therefrom for rotating said cap relative to said block.

13. The sprayer device according to claim 10, wherein said shaft includes a longitudinal groove formed therein for communicating with said opening of said cap when said valve seat of said cap is disengaged from said shaft.

14. The sprayer device according to claim 10, wherein said guiding means includes a seat secured to said housing and having a bore formed therein, a casing rotatably secured to said housing and having a bore formed therein, and a pipe extended from said block and engaged through said bore of said casing and engaged with said bore of said seat.

15. The sprayer device according to claim 14 further comprising means for retaining said casing to said seat.

16. The sprayer device according to claim 14 further comprising a hood rotatably received in said housing and including a peripheral shoulder formed therein, said seat includes a peripheral flange extended therefrom for engaging with said peripheral shoulder of said hood and for rotatably securing said hood to said housing.

17. The sprayer device according to claim 16 further comprising a control ferrule rotatably engaged in said housing and engaged between said hood and said housing, and means for securing said hood to said control ferrule for allowing said hood to be rotated relative to said housing with said control ferrule.

* * * * *